US005520394A

United States Patent [19]

Brueckner

[11] Patent Number: 5,520,394

[45] Date of Patent: May 28, 1996

[54] WORD FORMING BOARD GAME

[76] Inventor: James L. Brueckner, 8223 Blackburn Ave. #304, Los Angeles, Calif. 90048

[21] Appl. No.: 429,852

[22] Filed: Apr. 24, 1995

[51] Int. Cl.[6] ..... A63F 3/00

[52] U.S. Cl. ..... 273/272; 273/291

[58] Field of Search ..... 273/236, 272, 273/288, 291

[56] References Cited

U.S. PATENT DOCUMENTS

| | | | |
|---|---|---|---|
| 1,553,835 | 9/1925 | Peters | 273/272 |
| 3,191,938 | 6/1965 | Smith | 273/272 |
| 3,396,972 | 8/1968 | Smith | 273/272 |
| 3,779,557 | 12/1973 | Kritzberg et al. | 273/272 |
| 4,306,724 | 12/1981 | Brzezinski | 273/272 X |
| 4,420,157 | 12/1983 | White et al. | 273/272 |
| 4,934,711 | 6/1990 | Runstein | 273/272 |
| 5,324,040 | 6/1994 | Panda | 273/272 |
| 5,395,118 | 3/1995 | Barrett | 273/272 |

FOREIGN PATENT DOCUMENTS

| | | | |
|---|---|---|---|
| 2227674 | 8/1990 | United Kingdom | 273/272 |

*Primary Examiner*—William E. Stoll

[57] ABSTRACT

A game for forming words upon a board to entertain and educate players. The inventive device and method includes a board simulating various cross-word puzzle configurations upon which a plurality of tiles can be positioned to form words. The method of playing includes forming original and altered words upon the board. Score is kept during the game with the player having the highest score or the player covering a last one of a predetermined number and configuration of spaces on the board being declared the winner.

12 Claims, 3 Drawing Sheets

FIG 1
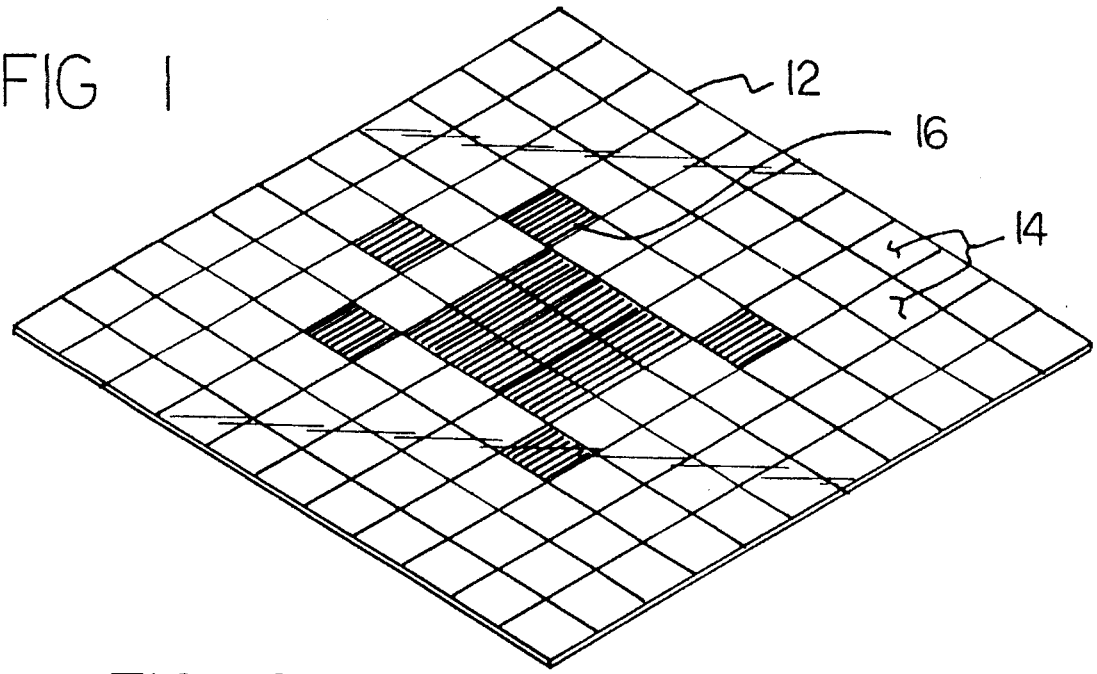
FIG 2
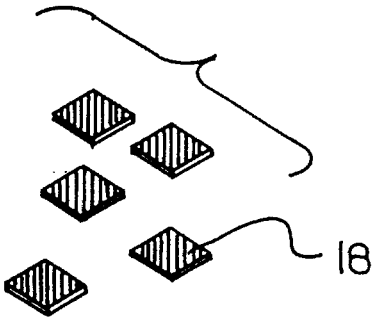
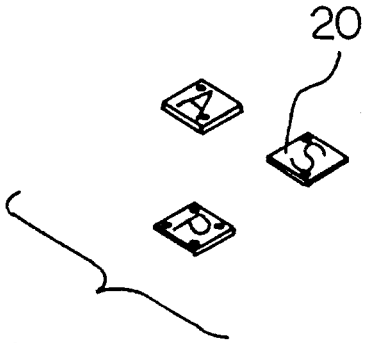
FIG 3
FIG 4
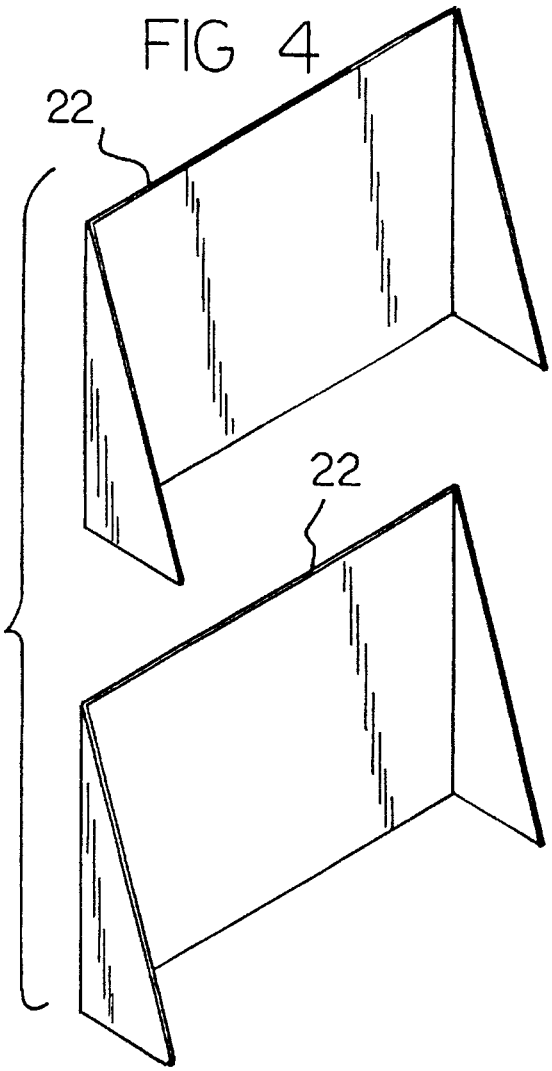

FIG 5
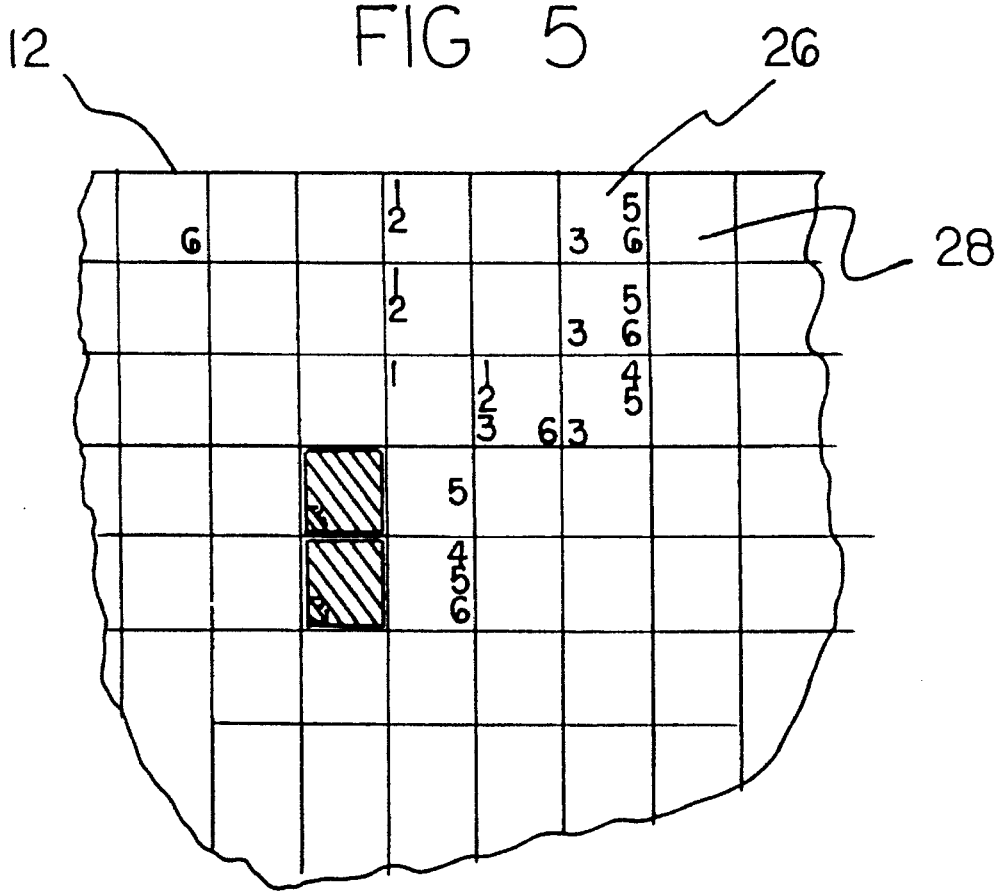
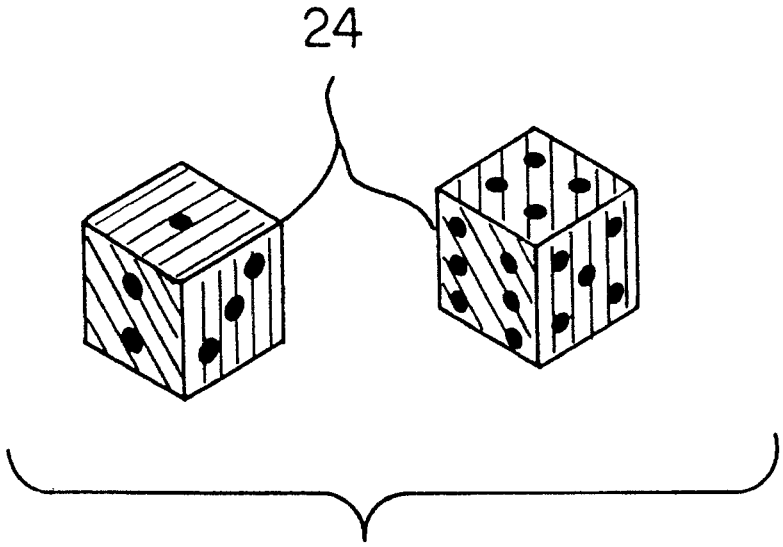
FIG 6

WORD FORMING BOARD GAME

BACKGROUND OF THE INVENTION

1. Field of the Invention

The present invention relates to board game structures and more particularly pertains to an word forming board game for forming words upon a board to entertain and educate players.

2. Description of the Prior Art

The use of board game structures is known in the prior art. More specifically, board game structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art board game structures include U.S. Pat. Nos. 4,014,548; 4,026,558; 3,565,439; 4,690,410; and 4,252,323.

While these devices fulfill their respective, particular objectives and requirements, the aforementioned patents do not disclose a word forming board game for creating words upon a board to entertain and educate players which includes a board simulating various cross-word puzzle configurations upon which a plurality of tiles can be positioned to form words, wherein a method of play includes forming original and altered words upon the board and score is kept during the game with the player having the highest score or the player covering a last one of a predetermined number and configuration of spaces on the board being declared the winner.

In these respects, the word forming board game according to the present invention substantially departs from the conventional concepts and designs of the prior art, and in so doing provides an apparatus primarily developed for the purpose of forming words upon a board to entertain and educate players.

SUMMARY OF THE INVENTION

In view of the foregoing disadvantages inherent in the known types of board game structures now present in the prior art, the present invention provides a new word forming board game construction wherein the same can be utilized for entertainment and educational purposes. As such, the general purpose of the present invention, which will be described subsequently in greater detail, is to provide a new word forming board game apparatus and method which has many of the advantages of the board game structures mentioned heretofore and many novel features that result in a word forming board game which is not anticipated, rendered obvious, suggested, or even implied by any of the prior art board game structures.

To attain this, the present invention generally comprises a game for forming words upon a board to entertain and educate players. The inventive device and method includes a board simulating various cross-word puzzle configurations upon which a plurality of tiles can be positioned to form words. The method of playing includes forming original and altered words upon the board. Score is kept during the game with the player having the highest score or the player covering a last one of a predetermined number and configuration of spaces on the board being declared the winner.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new word forming board game apparatus and method which has many of the advantages of the board game structures mentioned heretofore and many novel features that result in a word forming board game which is not anticipated, rendered obvious, suggested, or even implied by any of the prior art board game structures, either alone or in any combination thereof.

It is another object of the present invention to provide a new word forming board game which may be easily and efficiently manufactured and marketed.

It is a further object of the present invention to provide a new word forming board game which is of a durable and reliable construction.

An even further object of the present invention is to provide a new word forming board game which is susceptible of a low cost of manufacture with regard to both materials and labor, and which accordingly is then susceptible of low prices of sale to the consuming public, thereby making such word forming board games economically available to the buying public.

Still yet another object of the present invention is to provide a new word forming board game which provides in the apparatuses and methods of the prior art some of the advantages thereof, while simultaneously overcoming some of the disadvantages normally associated therewith.

Still another object of the present invention is to provide a new word forming board game for forming words upon a board to entertain and educate players.

Yet another object of the present invention is to provide a new word forming board game which includes a board simulating various cross-word puzzle configurations upon which a plurality of tiles can be positioned to form words, wherein a method of play includes forming original and altered words upon the board and score is kept during the game with the player having the highest score or the player covering a last one of a predetermined number and configuration of spaces on the board being declared the winner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a game board comprising a portion of the present invention.

FIG. 2 is an isometric illustration of a plurality of pattern tiles.

FIG. 3 is an isometric illustration of a plurality of letter tiles.

FIG. 4 is an isometric illustration of a plurality of blinds.

FIG. 5 is an enlarged plan view of a portion of the game board.

FIG. 6 is an isometric illustration of the die utilized in the invention.

DESCRIPTION OF THE PREFERRED EMBODIMENT

Figure 7:
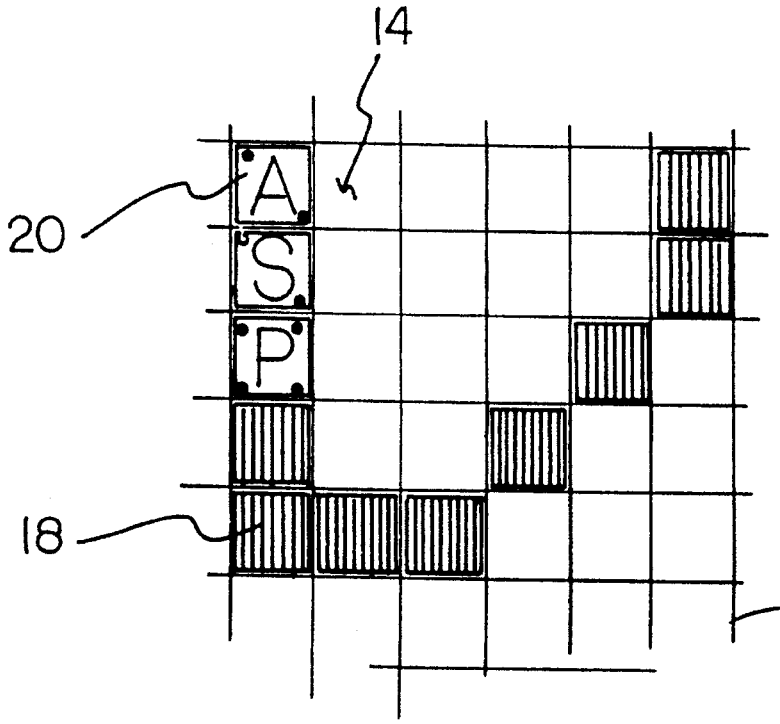
FIG. 7 is a plan view of a portion of the game board illustrating a game method.

With reference now to the drawings, and in particular to FIGS. 1–8 thereof, a new word forming board game embodying the principles and concepts of the present invention and generally designated by the reference numeral 10 will be described.

More specifically, it will be noted that the word forming board game 10 comprises a game board 12 divided into a plurality of squares 14 and including a plurality of shaded squares 16 arranged in a particular pattern relative to the game board 12, as shown in FIG. 1. The apparatus 10 further includes a plurality of pattern tiles 18, as shown in FIG. 2, and a plurality of letter tiles 20 which are colored red on a first side and green on a second side, as shown in FIG. 3. The tiles 18 and 20 are operable to be positioned upon the game board 12 so as to reside within one of the plurality of squares 14 demarcated thereon. The letter tiles 20, as shown in FIG. 3, are each provided with a letter of the alphabet printed thereon and a number between one and six, preferably an even number between two and six, indicated by one or more dots positioned proximal to the edges of each letter tile adjacent to the letter thereof. As shown in FIG. 4 invention 10 may further include a plurality of blinds 22 behind which the letter tiles 20 may be positioned for shielding of the letter tiles From view by other players. At least one die 24, as shown in FIG. 6, can be utilized to determine a positioning of the pattern tiles 18 on the game board 12, as well as to determine the first player of the game method.

As shown in FIG. 5, the game board 12 is further provided with a plurality of numbered squares 26 comprising one or more of the numbers one (1) through six (6) positioned within an individual one of the plurality of squares 14 to define each numbered square 26. Further, the game board 12 includes blank squares 28 having no other marking within one or more of the plurality of squares 14. To initiate play of the game method, a die 24 is rolled, with the number generated thereby indicating placement of the pattern tiles 18 onto a particular group of numbered squares 26 including such generated number by the die. In other words, should the die be rolled to generate a three (3), the pattern tiles 18 will be positioned onto all of the numbered squares 26 which include a three (3) therewithin. Preferably, the plurality of shaded squares 16 comprises a total of sixteen shaded squares, with four of such squares including an individual one of the numbers one (1) through six (6) to define a total of four numbered squares 26 which are also shaded squares such that four pattern tiles 18 will be positioned onto four of the sixteen shaded squares 16 as described above.

To determine the player initiating the game method, the die 24 is preferably provided with alternately colored pips. To this end, the pips one (1), three (3), and five (5) on the die are green, with the pips two (2), four (4), and six (6) being red in color. A roll of the die 24 is made to determine both the starting player and the game board configuration. For example, should a three (3) be rolled on the die 24, the roller of the die will play the green side of the letter tiles 20, with the opponent playing the red side of the letter tiles 20. Preferably, the player utilizing the green side of the letter tiles will always start the game first, wherein the initial roll of the die 24 indicates which player plays the green letter tiles 20 as described above. The twenty-four pattern tiles are then placed on the correspondingly numbered squares 26 on the game board 12 to create a pattern simulating a cross-word puzzle. Preferably, the pattern generates adjacent pluralities of uncovered numbered squares 26 or blank squares 28 which will accommodate words from two to six letters in length. Further, because only four of the sixteen shaded squares 16 are covered, twelve shaded squares will remain exposed to define an area of the game board 12 referred to as "the realm".

The method of play of the game further comprises mixing the letter tiles 20, with each player extracting eight of the letter tiles from a pouch or other opaque container. The eight letter tiles 20 are then positioned face up in the assigned color behind the respective player's blind 22 and can be utilized to form words upon the board in a manner which will subsequently be described in more detail.

In addition, each player receives a dictionary tile entitling the player to utilize an unillustrated dictionary agreed upon by both players before beginning play of the game. Thus, as words are formed on the game board 12, any word may be challenged for correct spelling after it is placed on the board. A word challenged that is not in the dictionary is either removed, with the player losing the turn and being forced into "tile penalty" with the player's turn being ended, or alternatively the word is removed with the player surrendering his dictionary tile to permit the player to play another word, thus avoiding tile penalty. "Tile penalty" results from a situation where a player is unable to play, or when a player no longer possess or declines to use a dictionary tile in a situation in which a word is successfully challenged as improper and is thus removed from the board. The player is penalized during a tile penalty by having to remove one letter tile from behind the blind 22 from the eight (8) therebehind for permanent removal from the game. The player's score is then reduced by ten (10) times the value of the tile removed. A letter tile is then drawn from the opaque container to bring the total number of tiles held behind the blind 22 back to eight. If the blind has been exhausted, i.e. the number of tiles therebehind reduced to zero, during a tile penalty, then the player goes out, the game is over, and the winner is decided by the adjusted (after tile penalty) final scores (winner having the highest score).

It should be noted that once a word is formed on the game board 12 without being challenged, and is followed by another play, the word can no longer be challenged. Further, the dictionary tiles may also be used before playing to ascertain whether a certain word or spelling can be found within the dictionary. The player thus gives up his dictionary tile and spells the requested word, with the opponent verifying such word within the dictionary. Because the player is under no obligation to actually utilize the word during play, this method can be effective as a deception late in the game when there is a question of which tiles are held by the players and which remain in the pouch or opaque container.

It should be emphasized that all words found in the agreed upon dictionary are allowed, be they secondary spellings, proper nouns, designated as foreign, archaic, slang, or otherwise. However, there are no hyphens, apostrophes, periods, or blank spaces permitted in forming of a word upon the game board 12. Further, words requiring such hyphens, apostrophes, periods, or blank spaces are unacceptable for use during the game. However, abbreviations listed in the dictionary without periods are acceptable. Roman numerals are also allowed, but only when arranged in declining values, excepting "IV" and "IX" situations. For example, the roman numeral LIV (fifty-four) can be utilized as a word, with the roman numeral XCC (one-hundred-ninety) being unusable as a word during play of the game.

A turn of play of the game is consummated by either forming a word from the players letter tiles called an "original word", or by using one or more tiles in the player's possession to change a word already on the board called an "altered word". After each play of the game, score is taken and the player's letter tiles are replenished by drawing from the opaque container until the total number held behind the blind 22 is equal to eight. The player's tiles continue to be replenished after each play of the game until the tiles have been exhausted from the opaque container. Preferably, there are a total of ninety (90) letter tiles which each include a single letter of the alphabet printed thereon. An example of the number of each corresponding letter tiles is as follows (letter—number of tiles—and number value): A-9-2; B-2-4; C-2-4; D-5-2; E-12-2; F-2-4; G-2-4; H-2-4; I-8-2; J-1-6; K-1-6; L-3-2; M-2-4; N-3-2; O-8-2; P-2-4; Q-1-6; R-5-2; S-5-2; T-3-2; U-4-2; V-2-4; W-2-4; X-1-6; Y-2-4; Z-1-6.

It should be emphasized that words formed along the game board 12 must extend from left to right or top to bottom within a single row or column, respectively. Words are preferably not permitted to be formed diagonally across the game board 12.

After initiating play of the game by a first player forming an original word on the game board 12, such original word will be scored by multiplying the sum of the letter tile values by the number of letters in the word. As noted above, each of the letter tiles 20 is provided with a letter of the alphabet thereon and is also provided with a number between one and six, preferably an even number between two and six, indicated by one or more dots positioned along the edges of each letter tile adjacent to the letter printed thereon. Thus, and as shown in FIG. 7, if the green player begins the game by playing the word "ASP", the resulting score will be a sum of the numbers indicated on the tiles utilized to form the word multiplied by the total number of letters in the word. In this case, the tile marked "A" is equal to a value of two (2), the tile marked "S" is also equal to a value of two (2) and the tile marked "P" is equal to a value of four (4). Thus, a sum of the tiles "A", "S", and "P", is equal to eight (8). The sum of eight (8) is then multiplied by the number of tiles, in this case three (3) tiles, with the resulting score being equal to three (3) times eight (8) or twenty-four (24). Such score is recorded on a paper or other recording device to permit cumulative score of the game 10.

Figure 8:
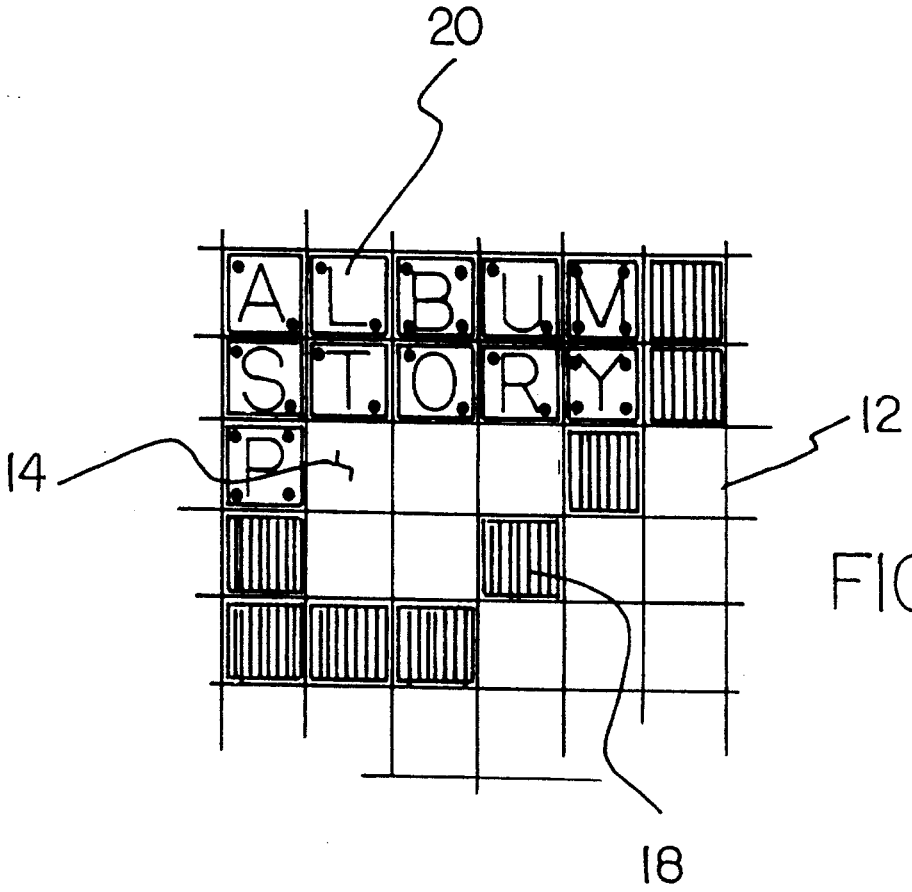
FIG. 8 is an enlarged plan view of the portion of the game board illustrated in FIG. 7 detailing the game method.

The red player can then play the word "ALBUM", as shown in FIG. 8, by placing the red letter tiles 20 into the squares 14 which are not covered by one of the pattern tiles 18. The word "ALBUM", because it fills at least one empty square 14 is considered an original word. As shown in FIG. 8, the sum of the numbers indicated on the letter tiles 20 utilized to create the word "ALBUM" is equal to fourteen (14). Multiplying this sum (74) by the number of tiles utilized in the original word, in this case five (5), is a total score for the red player of seventy (70). It should be noted that the word "ASP" is formed of green letter tiles at this point, with the word "ALBUM" being formed of a green letter tile "A" and red letter tiles "LBUM".

The turn of play is then given back to the green player who, in this exemplary case can play the original word "STORY" in green letter tiles as shown in FIG. 8. Such play by the green player creates two original words "STORY" and "MY". The green player receives scoring credit for both original words, in this case "STORY" has a scoring value of the sum twelve (12) multiplied by five (5) letters to give a score of sixty (60), with the word "MY" having a value of the sum eight (8) multiplied by two (2) letters equal to sixteen (16). Thus, the green player receives a total of seventy-six (76) points added to the green player's score.

In addition to the original words formed upon the game board 12, existing words positioned on the game board 12 may be changed to form an "altered word". An altered word can be formed by replacing a single letter up to every letter in an existing word, as long as each letter removed is replaced by a different letter of the alphabet. Thus, the red player may change the original word of green letter tiles "STORY" to read "SHORE" by positioning an red "H" letter tile as a replacement of the green "T" letter tile and a red "E" letter tile as a replacement for the green "Y" letter tile. Such alteration of the original word "STORY" results in a first altered word "SHORE" and a second altered word "ME". To score an altered word, only the numbers indicated on the tiles are added together. In other words, there is no multiplication of the sum of the numbers of the tiles by the total number of tiles as is done only for an original word. In this case, the letters "S", "O", "R", and "E" have a number value of two (2), with the tile "H" having a value of four (4) to result in a sum of twelve (12). Further, the altered word "ME", because the letter tile "E" has a value of two (2), results in a sum of four (4) plus two (2) equal to six (6).

It is important to note that in the forming of an altered word, the player who forms the altered word gains an option to keep or discard the tiles removed in creating the altered word. In other words, and for this example, the removed "T" and "Y" tiles can be utilized to replenish the player's tile supply behind the blind 22. Alternatively, one or both of the letter tiles can be discarded with replenishing letter tiles being taken from the opaque container. Once a tile is discarded through removal of the tile from the game board 12, the removed tile or tiles are not utilized during future play of the game and remain face up in a viewing position for both players to see. Further, the dictionary tiles, once utilized, also remain face up in view for accounting purposes.

It is also possible to form an original word and an altered word simultaneously, wherein scoring of the original word takes place as described above, and scoring of the altered word similarly takes place as described above. The player forming such an original word and an altered word simultaneously is awarded the scored points for each word.

An important rule for use in a situation where an original word and an altered word are simultaneously formed and when an opponent's letter tile is removed from the game board 12 to create such an altered word is that the opponent's score is reduced by ten (10) times the value of the sum off the captured tile or tiles from the opponent's score. In other words, a removed tile having a value of two (2) belonging to an opponent will result in total number of points equal to twenty (20) being subtracted from the opponent's score. Such sizable score reduction for tile capture serves to emphasize an importance of defensive planning in the playing of the game. In other words, careful consideration must be given to vulnerable letter tiles when developing a word for play, and again when deciding where to place such word on the board 12. Further, because many of the letter tiles 20 are disparately valued, letter tiles having a high value (i.e. four (4) or six (6)) should be positioned in defensive positions wherein they are least susceptible to capturing.

Victory in the game 10 is achieved by capturing the realm, or by the highest score when the realm is not captured. In other words, the player capturing the realm is declared the winner regardless of score, with the players' scores determining a winner should the realm not be captured. capturing of the realm is achieved when an acceptable original word covers the last shaded square 16 which is not covered by a pattern tile 18. Thus, regardless of the players' score, capturing of the realm by creating an original word filling the last shaded square 16 is a goal that should be kept in sight throughout the game. A player falling behind in score will necessarily abandon scoring for strategies geared at covering the shaded squares, with the player having a significant point advantage concentrating on defending the realm by preventing such covering of all of the shaded squares 16 or "realm".

With the realm successfully protected from capture and the tiles in the pouch or opaque container exhausted, a player goes out of the game by using up the tiles remaining in his possession. Play of the game ceases and the opponent's score is then adjusted downward by the sum of the tile values remaining multiplied by the number off tiles remaining. Victory then goes to the player with the highest score.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts off the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A word forming board game comprising:

(a) providing a game board divided into a plurality off blank squares and including a plurality of shaded squares arranged in a pattern relative to the game board;

(b) providing a plurality of letter tiles being of a first color on a first side thereof and being of a second color on a second side thereof, the letter tiles each having a single letter of the alphabet printed on both sides and a number value indicated thereon, the tiles being positionable upon the game board so as to reside within one of the plurality of squares demarcated thereon;

(c) selecting a first player for initiating the game and for utilizing the first color of the letter tiles, and selecting a second player for utilizing the second color of the letter tiles;

(d) randomly selecting a plurality of the letter tiles by the first player for use in the first color as first color letter tiles;

(e) randomly selecting a plurality of the letter tiles by the second player for use in the second color as second color letter tiles;

(f) forming a word by the first player from the first color letter tiles by a word forming method selected from the group consisting of: (1) placing the first color letter tiles into adjacent empty squares including at least one uncovered square to form at least one "original word"; (2) placing the first color letter tiles in place of letter tiles covering squares of the board to form an "altered word"; and (3) placing the first color letter tiles into adjacent blank squares including at least one uncovered square to form at least one "original word" and simultaneously placing the first color letter tiles into covered squares to form at least one "altered word";

(g) scoring by a scoring method selected from the group consisting of: multiplying a sum of the letter tile number values utilized in forming the word by a number of letter tiles utilized in forming the word for an "original word"; and summing the letter tile number values utilized in forming the word for an "altered word".

2. The word forming board game of claim 1, wherein step (a) further comprises providing a plurality of pattern tiles; and further wherein step (c) further comprises placing a plurality of the pattern tiles onto shaded squares and blank squares of the game board.

3. The word forming board game of claim 2, wherein step (a) further comprises providing a die having numbered pips; and further wherein the game board includes a plurality of numbered squares comprising at least one number positioned within an individual one of the plurality of squares to define each numbered square; and still further wherein the step of placing a plurality of the pattern tiles onto shaded squares and blank squares of the game board comprises rolling the die to generate a number, and placing the pattern tiles onto the correspondingly numbered squares of the board.

4. The word forming board game of claim 1, wherein step (a) further comprises providing a plurality of blinds for placing letter tiles behind for shielding of the letter tiles from view by other players.

5. The word forming board game of claim 1, wherein step (a) further comprises providing a dictionary tile entitling a player to utilize a dictionary during play of the game.

6. The word forming board game of claim 1, wherein step (a) further comprises providing a die having alternately colored pips; and step (c) comprises rolling the die to determine a starting player in accordance with a color of an upward facing one of the pips.

7. The word forming board game of claim 1, wherein the step (f) further comprises providing a player who forms an "altered word" an option selected from the group consisting of: keeping the letter tiles removed in creating the "altered word"; and discarding the letter tiles removed in creating the "altered word".

8. The word forming board game of claim 1, wherein when at least one original word and at least one altered word are simultaneously formed in step (f) and at least one of the opponent's letter tiles is removed from the game board to create the "altered word", an opponent's score is reduced by a multiple of a number value of the sum of the removed tile(s).

9. The word forming board game of claim 1, wherein victory in the game is achieved by a player placing a tile into a last one of a predetermined number and configuration of spaces on the board.

10. The word forming board game of claim 9, wherein victory in the game is achieved by a player having a highest score in absence of a tile being placed into a last uncovered shaded square on the board.

11. The word forming board game of claim 1, wherein step (g) further comprises replenishing letter tiles after each play of the game.

12. The word forming board game of claim 1, wherein words formed along the game board must extend in a direction selected from the group consisting of: from left to right within a single row, and from top to bottom within a single column so as to fill all spaces extending within either of the single row and single column.

* * * * *